United States Patent [19]

Blaskowski

[11] 4,276,928

[45] Jul. 7, 1981

[54] SUPERHEATER INLET/OUTLET HEADER

[75] Inventor: Henry J. Blaskowski, West Simsbury, Conn.

[73] Assignee: Combustion Engineering, Inc., Windsor, Conn.

[21] Appl. No.: 11,298

[22] Filed: Feb. 12, 1979

[51] Int. Cl.[3] ..... F28F 5/00

[52] U.S. Cl. ..... 165/82; 122/32

[58] Field of Search ..... 176/38, 60, 65; 122/32, 122/34; 165/158, 160, 81, 82

[56] References Cited

U.S. PATENT DOCUMENTS

| | | | |
|---|---|---|---|
| 3,125,161 | 3/1964 | Romanos | 165/159 |
| 3,520,356 | 7/1970 | Bell et al. | 165/158 X |
| 3,888,730 | 6/1975 | Jackson | 176/65 X |

*Primary Examiner*—Samuel Scott

*Assistant Examiner*—Theophil W. Streule, Jr.

*Attorney, Agent, or Firm*—William W. Habelt

[57] ABSTRACT

A heat exchanger having a shell lined with a plurality of heat transfer tubes, heat exchange surface disposed within the shell and submerged in a first heat transfer fluid, and a tube manifold penetrating through the shell and directing a second heat transfer fluid to and from the heat exchange surface. The tube manifold has an elongated L-shaped outer enclosure which has one leg disposed within the shell and the other leg penetrating through the shell, and an elongated L-shaped inner tube which passes through the outer enclosure. A first fluid flow path through the tube manifold is established through the inner tube and a second fluid flow path through the tube manifold is established between the inner tube and the outer enclosure.

3 Claims, 4 Drawing Figures

SUPERHEATER INLET/OUTLET HEADER

BACKGROUND OF THE INVENTION

This invention relates to a tube manifold of the type that directs the flow of a heat transfer fluid to and from a heat exchanger immersed in another heat transfer fluid and, more particularly, to a combined inlet/outlet header for directing the flow of steam through a superheater disposed in the flue gas stream.

It is often necessary to transfer heat between two fluids without the two fluids coming into contact. This is frequently done by submerging a heat exchanger in a first heat transfer fluid and passing a second heat transfer fluid through the heat exchanger, such that the fluids pass along opposite sides of the heating surface and heat is transferred between the two fluids across the heating surface. A conventional heat exchanger of this type comprises a shell adapted to confine the first heat transfer fluid, a heat exchanger typically in the form of a bundle of tubes submerged in the first heat transfer fluid, and a tube manifold for directing the flow of the second heat transfer fluid through the shell to the heat exchanger, through the heat exchanger and back out of the shell.

A major problem is encountered when utilizing such a heat exchange arrangement if there is a substantial difference in temperature between the two heat transfer fluids or if the second heat transfer fluid undergoes a substantial temperature change as it passes through the heat exchanger resulting in a sizable temperature gradient within the tube manifold itself. Temperature differences such as these result in thermal stresses between the shell that confines the first heat transfer fluid and the tube manifold where it penetrates the shell, and also within the tube manifold itself.

If there is a substantial temperature difference between the shell and the tube manifold, the resulting thermal stresses could cause rupture of the weld joining the tube manifold to the shell and destroy the seal therebetween. In practice, this problem is typically avoided by incorporating a nozzle into the shell and a thermal sleeve in the tube manifold at the point where the tube manifold passes through the nozzle and out of the shell.

If substantial temperature differences exist within the tube manifold, the resulting thermal stresses could result in rupture of the tube manifold and destroy the required separation between the inlet and outlet fluid pathways through which the second heat transfer fluid passes. This difficulty is most often avoided by providing a flexible section of piping within the tube manifold to absorb the differential expansion between the inlet and outlet pathways or by providing a fluid-tight slip joint arrangement at the point where the inlet and outlet pathways contact so as to permit differential expansion therebetween.

Accordingly, it is the purpose of this invention to provide a heat exchanger incorporating a tube manifold of unique design, thereby eliminating the aforementioned thermal stress problems and providing a simplified construction.

SUMMARY OF THE INVENTION

The present invention provides a heat exchanger having a shell, the interior of which is lined with a plurality of heat transfer tubes, for confining a first heat transfer medium; a heat exchanger disposed within the shell and submerged in the first heat transfer fluid; and a tube manifold penetrating through the shell and directing a second heat transfer fluid to and from the heat exchanger. The tube manifold has an elongated L-shaped outer enclosure which has one leg disposed within the shell and the other leg penetrating through the shell, and an elongated L-shaped inner tube which passes through the outer enclosure thereby establishing a flow pathway therethrough and which is rigidly mounted at one end to one end of the outer enclosure and at its other end to the other end of the outer enclosure.

If it is desired to heat a second heat transfer fluid by passing it in heat exchange relationship with a first heat transfer fluid, the cold second heat transfer fluid is passed upward through the tubes lining the interior of the shell to cool the shell and then passes through the outer enclosure of the tube manifold to the heat exchanger. The heated second heat transfer fluid returns from the heat exchanger and passes through the inner tube of the tube manifold and out of the shell.

Thus, the heated portion of the second heat transfer fluid is confined within the inner tube of the tube manifold and is completely surrounded by the cold portion of the second heat transfer fluid flowing within the outer enclosure. Thermal stress between the shell and the tube manifold is eliminated because the outer enclosure of the tube manifold and the shell are both in direct contact with the cold second heat transfer fluid and maintained at approximately the same temperature. Because of the L-shaped design of the inner tube and the outer enclosure and despite the rigid connection therebetween at their ends, the inner tube is permitted to freely expand or contract at the elbow thereby eliminating any thermal stress within the tube manifold due to the differential expansion between the inner tube and the outer enclosure.

BRIEF DESCRIPTION OF THE DRAWINGS

The present invention may be better understood by reference to the accompanying drawings wherein.

DESCRIPTION OF THE PREFERRED EMBODIMENT

Figure 1:
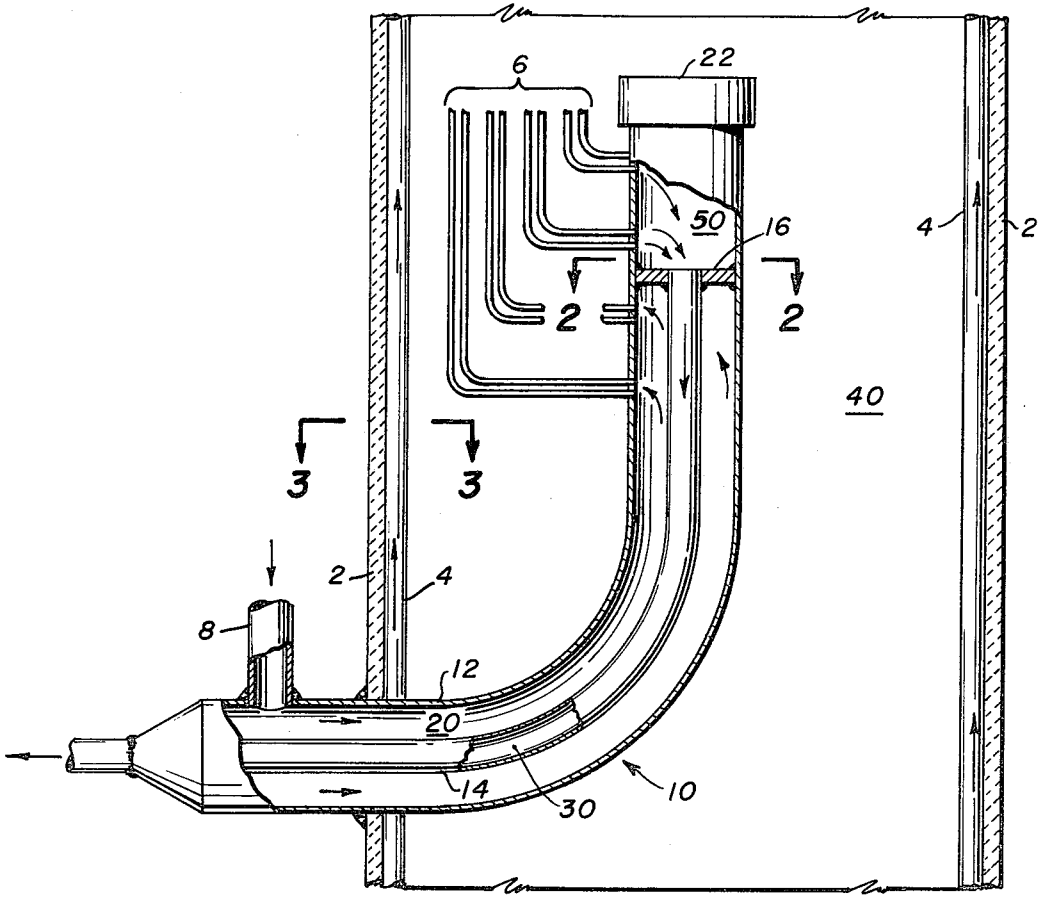
FIG. 1 is a sectional view of a tube manifold constructed in accordance with the invention and shown at the point where the tube manifold penetrates the heat exchanger shell.
Figure 2:
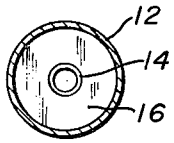
FIG. 2 is a view in cross section taken along line 2—2 of FIG. 1.
Figure 3:
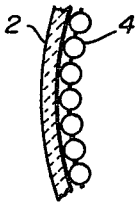
FIG. 3 is a view in cross section taken along line 3—3 of FIG. 1.

The heat exchange apparatus shown in FIG. 1 constitutes a representative means of providing heat exchange between two heat transfer fluids in accordance with the present invention. Heat exchange surface 6 is submerged within the first heat transfer fluid confined within shell 2. Shell 2 is typically a thick structural wall such as a pressure containment vessel and, in accordance with the invention, is lined by a plurality of heat exchange tubes 4. Taken together, shell 2 and heat transfer tubes 4 define a chamber 40 in which the first heat transfer fluid, which may be a liquid or a gas, hot or cold, quiescent or flowing, is confined.

Tube manifold 10 is formed of an elongated L-shaped outer enclosure 12 and an elongated L-shaped inner tube 14 which passes through the outer enclosure 12. One end of inner tube 14 is rigidly mounted to one end of outer enclosure 12 and the other end of inner tube 14 is rigidly mounted to the other end of outer enclosure 12. As seen in FIG. 1, tube manifold 10 is orientated with respect to shell 2 such that one leg of tube manifold 10 is completely disposed within chamber 40 and the other leg of tube manifold 10 penetrates through shell 2 to the outside. A first fluid flow path 30 through tube manifold 10 is established through inner tube 14, and a second fluid flow path 20 through tube manifold 10 is established between inner tube 14 and outer enclosure 12.

Heat exchanger 6 is connected between the second fluid flow pathway 20 and the first fluid flow pathway 30 of tube manifold 10 so as to establish a flow path whereby the second heat transfer fluid is passed in heat exchange relationship with the first heat transfer fluid as the second heat transfer fluid passes between the first flow path 30 and the second flow path 20 of tube manifold 10. Flow nozzle 8 opens into and is welded to the outer enclosure wall of tube manifold 10 at a location outside of the shell 2.

In the preferred embodiment, the outer enclosure 12 is divided into a first chamber 20 and a second chamber 50 by division plate 16. Inner tube 30 is disposed within the outer enclosure 12 and has one end secured to division plate 16 so as to provide a flow path from the second chamber 50 through the first chamber 20 to the outside. Heat exchanger 6 is connected between the first chamber 20 and the second chamber 50 and provides a heat exchange flow path therebetween. A ceramic tile cap 22 is secured to the end of the outer enclosure disposed within chamber 40 of shell 2 and serves to protect the end of tube manifold 10 from impingement by the first heat transfer fluid, which could frequently be a hot, corrosive flue gas.

Figure 4:
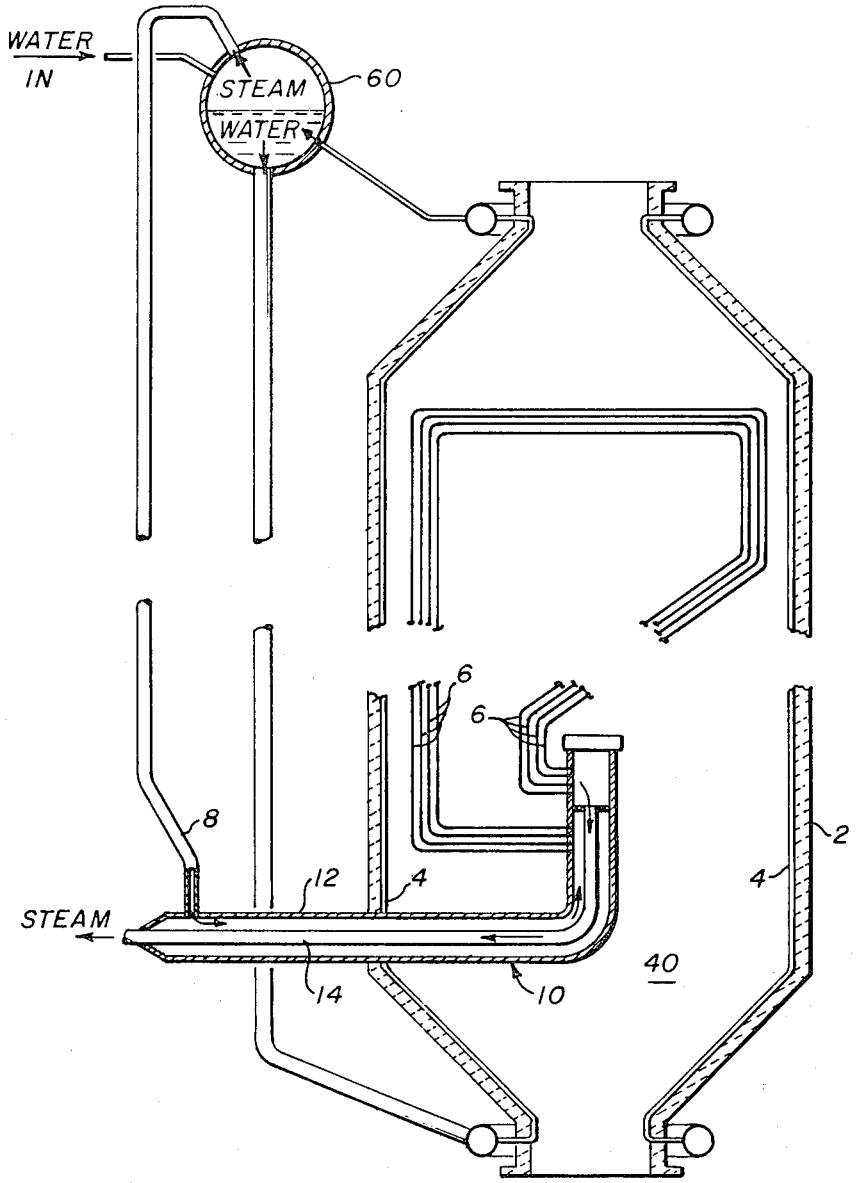
FIG. 4 is a sectional side elevation view of a steam generating heat exchange apparatus incorporating a tube manifold of FIG. 1 as a superheater inlet/outlet header.

The operation of the heat exchanger can best be explained and its advantages made most apparent when discussing the use of the heat exchanger to superheat steam, as illustrated in FIG. 4, by passing saturated steam through heat exchange surface immersed in a hot flue gas stream. In operation, saturated or slightly subcooled water will be circulated upwards through heat transfer tubes 4 lining shell 2 thereby protecting shell 2 from the hot gases flowing through chamber 40 and cooling shell 2 as the water passing through heat transfer tubes 4 evaporates into steam. The steam/water mixture leaving tubes 4 would be directed to a steam drum 60, wherein the steam/water mixture would be separated into saturated steam and saturated water. The saturated water would then be mixed with additional makeup feed water and recirculated through heat transfer tubes 4 to cool shell 2. The saturated steam would be passed to tube manifold 10 entering the first chamber 20 of the outer enclosure 12 through nozzle 8. The saturated steam would then pass from the first chamber 20 of outer enclosure 12 through heat exchange surface 6, preferably a plurality of tubes formed into a tube bundle, and reenter the outer enclosure 12 and be collected as superheated steam in the second chamber 50. The superheated steam would then pass through first chamber 20 and out of shell 2 by way of the inner tube 30. Division plate 16 would serve to separate the first chamber 20 from the second chamber 50 and thereby preclude mixing of the saturated and superheated steam.

The saturated or slightly subcooled water passing through heat exchange tubes 4 serves to cool the shell 2 to a metal temperature at or near the saturation point. Similarly, the saturated steam passing through the first chamber 20 serves to protect the outer enclosure 12 from the high temperature superheated steam passing through inner tube 14 and to maintain the outer enclosure 12 at a metal temperature at or near the saturation temperature. Therefore, there is no thermal stress developed between the shell and the outer enclosure at the point where the outer enclosure penetrates the shell. Accordingly, tube manifold 10 may be welded to the shell 2 without fear of rupture from thermal stresses.

As superheated steam is returned from heat exchange surface 6 through fluid flow passage 30, inner tube 14 will heat to a metal temperature at or near the temperature of the superheated steam, a temperature significantly higher than saturation temperature. Because outer enclosure 12 is at or near the saturation temperature, there is a differential thermal expansion between the outer enclosure 12 and the inner enclosure 14. In particular, inner tube 14 would tend to lengthen as it is heated above the saturation temperature while the outer enclosure 12 would tend to remain the same length because of the cooling provided by the saturated steam. As seen in FIG. 1, inner tube 14 is rigidly connected to outer enclosure 12 at a point outside of the shell and also is rigidly connected to the outer enclosure 12 at its other end through division plate 16. Therefore, the inner tube 14 would tend to expand horizontally inward towards chamber 40 and vertically downward away from division plate 16. Because of the elbow incorporated in the L-shaped design of inner tube 14, inner tube 14 is free to expand by distorting radially outward at the elbow. This relieves any thermal stress and prevents the rupture of inner tube 14.

If, on the other hand, inner tube 14 had been a straight length of pipe without any elbow, the thermal expansion required to relieve the stress would have resulted in rupture. It should be noted that although the L-shaped is preferred for inner tube 14 and correspondingly for the outer enclosure 12, any curvilinear shape having at least one elbow would suffice. Accordingly, it is to be understood that the term L-shaped is herein to be read to incorporate any curvilinear shape embodying an elbow, for example a Z-shape tube, a 45° elbow, a 30° elbow, or even a coil-like shape.

While a representative embodiment of the present invention has been shown and described for purposes of illustration, it is apparent that the heat exchange apparatus described herein may be used to cool the second heat transfer fluid by passing it through heat exchange surface 6 in heat exchange relationship with a cold fluid flowing in chamber 40 and over heat exchange surface 6 simply by reversing the direction of flow through the tube manifold. Therefore, the invention described herein is not to be construed as limited to the specific embodiment of a superheater inlet/outlet header as described but is intended to encompass all variations thereof coming within the scope of the claims.

What is claimed is:

1. A heat exchanger of the type for transferring heat between two heat transfer fluids without contact between the two fluids, comprising:

a. a shell;

b. a first plurality of heat exchange tubes lining the interior of the shell thereby defining a chamber within the shell for containing a first heat transfer fluid;

c. an elongated L-shaped outer enclosure having one leg disposed within said shell chamber and the other leg penetrating through and welded directly to the shell;

d. an elongated L-shaped inner tube disposed within said outer enclosure and spaced radially therefrom to provide an annular space therebetween; said inner tube having one leg rigidly connected to one leg of said outer enclosure and the other leg rigidly connected to the other leg of said outer enclosure at a point external of the shell, the interior of said inner tube defining a first flow path through said outer enclosure and said annular space defining a second flow path through said outer enclosure;

e. a second plurality of heat exchange tubes disposed within said shell chamber and interconnected in fluid communication between said annular chamber and said inner tube, said tubes providing a flow passageway for passing the second heat transfer fluid in heat exchange relationship with the first heat exchange fluid such that the temperature of the second heat transfer fluid is higher within said inner tube than within said outer enclosure; and f. means for passing the second heat transfer fluid first through the plurality of heat exchange tubes lining the interior of the shell, thence through said annular chamber, thence through said second plurality of heat exchange tubes, and thence out of the shell through said inner tube.

2. A heat exchanger as recited in claim 1 further comprising a division plate disposed between said inner tube and said outer enclosure and secured thereto so as to provide a rigid connection therebetween, the division plate providing a fluid-tight division of said annular chamber of said outer enclosure into a first chamber and a second chamber, the inner tube passing through said first chamber and opening into said second chamber.

3. A steam generating heat exchanger of the type wherein hot gases are cooled by evaporating water into steam and superheating said steam comprising:

a. a shell through the interior of which the hot gases are passed;

b. a first plurality of heat exchange tubes through which saturated water is passed in heat exchange relationship with the hot gases passing through said shell to generate steam, said tubes disposed to line the interior of said shell thereby protecting the shell from the hot gases;

c. a steam drum for collecting the steam and saturated water leaving said first plurality of heat exchange tubes;

d. an elongated L-shaped outer enclosure having one leg disposed within the interior of said shell and the other leg penetrating through and welded to the shell;

e. an elongated L-shaped inner enclosure disposed within said outer enclosure and spaced radially therefrom to provide an annular space therebetween, said inner tube having one leg rigidly connected to one leg of said outer enclosure and the other leg rigidly connected to the other leg of said outer enclosure at a point external of the shell, the interior of said inner tube defining an outer header through which superheated steam passes out of said shell and said annular space defining an inlet header through which saturated steam enters into said shell;

f. a second plurality of heat exchange tubes disposed within the interior of said shell and interconnected in fluid communication between said annular chamber and said inner tubes, said tubes providing a flow passageway for passing saturated steam from the inlet header of said annular chamber in heat exchange relationship with the hot gases to the outlet header of said inner tube;

g. means for passing saturated water from said drum through said first plurality of heat exchange tubes wherein steam is generated and returning the mixture of steam and saturated water leaving said tubes to said drum; and h. means for passing saturated steam from said drum to the inlet header of said annular chamber, thence through said second plurality of heat exchange tubes, and thence out of said shell through the outlet header of said inner tube.

* * * * *